US010118175B2

(12) United States Patent
Akella et al.

(10) Patent No.: US 10,118,175 B2
(45) **Date of Patent: *Nov. 6, 2018**

(54) METHOD AND SYSTEM FOR COORDINATION ON OPTICALLY CONTROLLED MICROFLUIDIC SYSTEMS

(71) Applicants: Srinivas Akella, Charlotte, NC (US); Zhiqiang Ma, Charlotte, NC (US)

(72) Inventors: Srinivas Akella, Charlotte, NC (US); Zhiqiang Ma, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/726,996

(22) Filed: Oct. 6, 2017

(65) Prior Publication Data

US 2018/0280979 A1 Oct. 4, 2018

Related U.S. Application Data

(63) Continuation of application No. 14/199,469, filed on Mar. 6, 2014, now Pat. No. 9,782,755.

(60) Provisional application No. 61/773,417, filed on Mar. 6, 2013.

(51) Int. Cl.
*B01L 3/00* (2006.01)
*F04B 19/00* (2006.01)

(52) U.S. Cl.
CPC ..... *B01L 3/502792* (2013.01); *F04B 19/006* (2013.01); *B01L 2300/089* (2013.01); *B01L 2300/0816* (2013.01); *B01L 2300/0819* (2013.01); *B01L 2400/0427* (2013.01); *B01L 2400/0454* (2013.01); *Y10T 137/2191* (2015.04)

(58) Field of Classification Search
CPC ..... B01L 3/502792; B01L 2300/0816; B01L 2300/0819; B01L 2300/089; B01L 2400/0427; B01L 2400/0454; F04B 19/006; Y10T 137/2191
See application file for complete search history.

(56) References Cited

PUBLICATIONS

Pei, Shao Ning et al., "Light-actuated digital microfluidics for large-scale, parallel manipulation of arbitrarily sized droplets," 23rd IEEE International Conference on Micro Electro Mechanical Systems, Wanchai, Hong Kong, Jan. 2010, pp. 252-255.
Park, Sung-Yong et al., "Single-sided continuous optoelectrowetting (SCOEW) for droplet manipulation with light patterns," Lab on a Chip, vol. 10, No. 13, Jul. 2010, pp. 1655-1661.

*Primary Examiner* — Shogo Sasaki
(74) *Attorney, Agent, or Firm* — Clements Bernard Walker PLLC; Christopher L. Bernard

(57) ABSTRACT

In accordance with one embodiment, a method for automatically coordinating droplets, beads, nanostructures, and/or biological objects for optically controlled microfluidic systems, comprising using light to move one or a plurality of droplets or the like simultaneously, applying an algorithm to coordinate droplet and/or other motions and avoid undesired droplet and/or other collisions, and moving droplets and/or others to a layout of droplets and/or others. In another embodiment, a system for automatically coordinating droplets and/or others for optically controlled microfluidic systems, comprising using a light source to move one or a plurality of droplets and/or others simultaneously, using an algorithm to coordinate droplet and/or other motions and avoid undesired droplet and/or other collisions, and using a microfluidic device to move droplets and/or others to a layout of droplets and/or others.

12 Claims, 11 Drawing Sheets

(a)

(b)

METHOD AND SYSTEM FOR COORDINATION ON OPTICALLY CONTROLLED MICROFLUIDIC SYSTEMS

CROSS REFERENCE TO RELATED APPLICATION

This application is a continuation of U.S. patent application Ser. No. 14/199,469 (now U.S. Pat. No. 9,782,775), filed on Mar. 6, 2014, which claims priority to U.S. Provisional Patent Application Ser. No. 61/773,417, filed on Mar. 6, 2013, both of which are hereby incorporated by reference in their entireties.

STATEMENT REGARDING FEDERALLY SPONSORED RESEARCH

This invention was made with government support under contract number IIS-1019160 awarded by the National Science Foundation. The government has certain rights in the invention.

FIELD

The present invention generally relates to microfluidic systems, and, more particularly, to optically controlled microfluidic systems.

PRIOR ART

Digital microfluidics deals with the manipulation of discrete liquid droplets, using manipulation technologies including electrowetting, dielectrophoresis, optical forces, magnetic forces, surface acoustic waves, or thermocapillary forces. However the effectiveness of some of the devices using these technologies has been limited. Some electrowetting devices for example, have fixed electrode configurations and/or fixed droplet volumes. Additionally, some devices are unable to move a droplet in a desired direction on a device surface, and/or have to address wiring of large numbers of electrodes.

Optically controlled digital microfluidic systems, also called optically controlled microfluidic systems or light-actuated digital microfluidic systems, typically use a continuous photoconductive surface enabling the projection of light to create virtual electrodes on the surface. These virtual electrodes can be used to transport, generate, mix, separate droplets, and for large scale multidroplet manipulation. An important advantage of these systems is that they are capable of moving droplets in different directions, able to move droplets of different volumes, reprogrammable, and therefore potentially very versatile in carrying multiple types of chemical reactions. For example, they can be used to create a miniature, versatile, chemical laboratory on a microchip ("lab on a chip").

However current solutions for controlling droplet movements in optically controlled microfluidic devices use manually programmed droplet movements. It is difficult to specify the motions of droplets manually, particularly when the number of droplets becomes large.

Hence there is a need for methods and systems for fully automated collision-free droplet coordination in optically controlled microfluidic systems.

SUMMARY

In accordance with one embodiment, a method for automatically coordinating droplets for optically controlled microfluidic systems, comprising using light to move one or a plurality of droplets simultaneously, applying an algorithm to coordinate droplet motions and avoid droplet collisions, and moving droplets to a layout of droplets.

In another embodiment, a system for automatically coordinating droplets for optically controlled microfluidic systems, comprising using a light source to move one or a plurality of droplets simultaneously, using an algorithm to coordinate droplet motions and avoid droplet collisions, and using a microfluidic system to move droplets to a layout of droplets.

These and other features and advantages will become apparent from the following detailed description in conjunction with the accompanying drawings.

DETAILED DESCRIPTION

We describe droplet manipulation on optically controlled microfluidic devices, with a goal of achieving collision-free and time-optimal droplet motions.

Embodiments described herein can be understood more readily by reference to the following detailed description, examples, and drawings and their previous and following descriptions. Elements, methods, and systems described herein, however, are not limited to the specific embodiments presented in the detailed description, examples, and drawings. It should be recognized that these embodiments are merely illustrative of the principles of the present invention.

Numerous modifications and adaptations will be readily apparent to those of skill in the art without departing from the spirit and scope of the embodiments.

Figure 1:
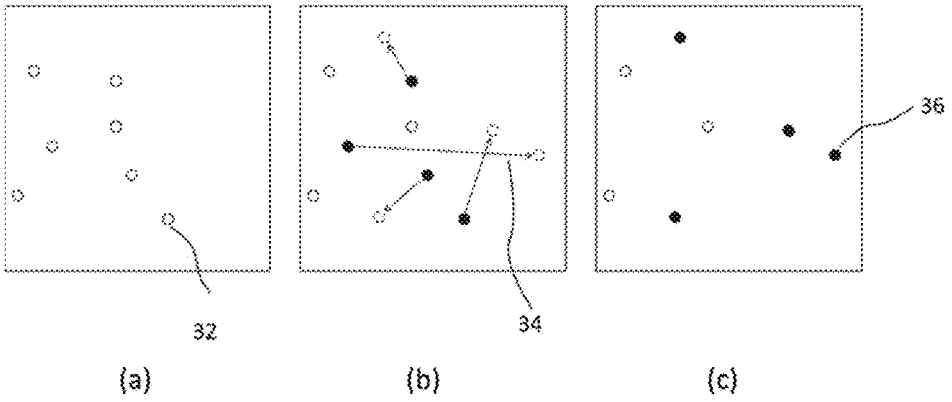
FIG. 1 illustrates schematic snapshots of droplets in an optically controlled digital microfluidic system. (a) Initial state. (b) Droplets to be moved are drawn shaded to represent the light source; arrows indicate the paths to their goal locations (dotted). (c) Goal state.

Optically controlled digital microfluidic systems, also referred to as optically controlled digital microfluidic systems or light-actuated digital microfluidic systems, are digital microfluidic systems where the lower substrate is a continuous photoconductive surface. Projection of light on the lower substrate effectively creates virtual electrodes in the illuminated regions. By moving the illumination regions, droplets can be moved anywhere on the microfluidic chips (as depicted in FIG. 1) to perform multiple chemical or biological reactions in parallel. Since droplets in these optically controlled devices are not restricted to moving on a fixed set of electrodes as in traditional digital microfluidic systems, optically controlled devices provide greater droplet motion freedom, the ability to variably change droplet sizes, and eliminate issues of wiring large numbers of electrodes. Droplet transport, generation, mixing, and separation operations can be performed with projected light patterns, and a large number of droplets can be manipulated in parallel. Hence proper droplet coordination is extremely important for optically controlled microfluidic devices. For instance, droplet collisions can contaminate droplets and should be avoided except when mixing is intended. Therefore an advantageous capability is to move droplets as quickly as possible to destinations without collisions. A significant application area is creating matrix formations of droplets, similar to microwell layouts, for biological applications.

Operation

Figure 11:
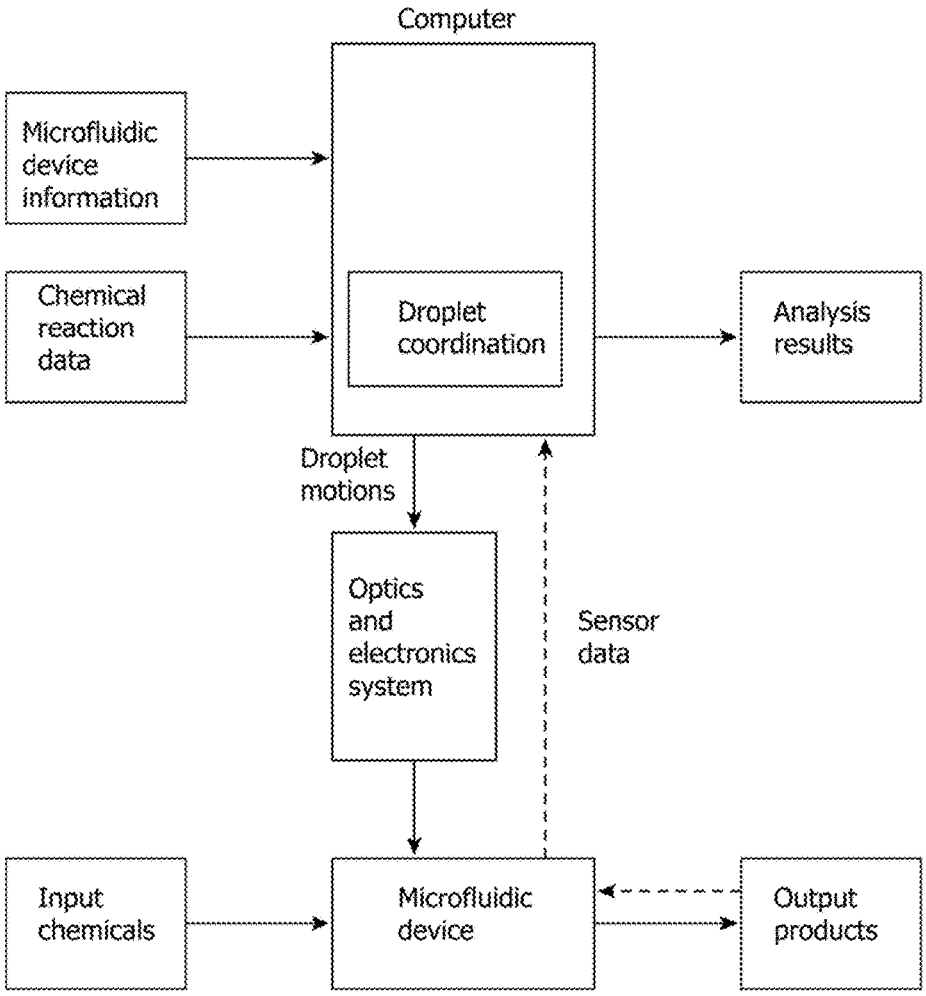
FIG. 11 illustrates one embodiment of a system for optically controlling droplets on a microfluidic device.

FIG. 11 illustrates one embodiment of a system for optically controlling droplets on a microfluidic device. Taking as inputs information on the microfluidic device and the chemical reaction to be performed, an algorithm computes collision-free motions for the droplets and energizes the optical and electronics system accordingly. The results of the reaction may be determined by using sensors.

I. Coordinating Multiple Robots with Specified Paths

Since our application involves multiple droplets moving in a shared workspace on a microfluidic device, we summarize our work on coordinating multiple robots with specified paths and trajectories. We use the term motion planning to refer to the generation of paths and trajectories for the robots, as well as the coordination of the robots. A motion planning algorithm will thus include the ability to generate robot paths and trajectories, as well as to coordinate the robots. Given a set of robots with specified paths and constant velocities, we can find the starting times for the robots such that the completion time for the set of robots is minimized and no collisions occur. We denote the ith robot by Ai, and the time when robot Ai begins to move by $t^{start}_i$; this is to be computed.

A. Collision Zones

Assume robots Ai and Aj can collide. We define Ai(γi(ζi)) as the workspace that Ai occupies at path parameter value ζi along its path γi. The geometric characterization of this collision is $$\mathcal{A}_i(\gamma_i(\zeta_i)) \cap \mathcal{A}_j(\gamma_j(\zeta_j)) \neq .$$

PBij is the set of all points on the path of robot Ai at which Ai could collide with Aj, and can be represented as a set of intervals $$\mathcal{PB}_{ij} = \{[\zeta_{is}^k, \zeta_{if}^k]\} \quad (1)$$

where each interval is a collision segment, and s and f refer to the start and finish of the kth collision segment. We refer to the corresponding pairs of collision segments of the two robots as collision zones, denoted by $PI_{ij}$. The set of collision zones, which describe the geometry of possible collisions, can be represented as a set of ordered pairs of intervals:

$$\mathcal{PI}_{ij} = \{[\zeta_{is}^k, \zeta_{if}^k]\} \quad (2)$$

For scheduling the robots, we must describe the timing of the collisions. Given the speed of the robots, the set of times at which it is possible that robot Ai could collide with robot Aj can be easily computed.

We refer to each interval as a collision-time interval. Let $T^k_{is}$ (respectively $T^k_{if}$) denote the time at which Ai starts (resp. finishes) traversing its $k^{th}$ collision segment if $t^{start}_i=0$. For the two robots Ai and Aj, we denote the set of all collision-time interval pairs by CIij, and represent it as a set of ordered pairs of intervals $$\mathcal{CI}_{ij} = \{<[T_{is}^k, T_{if}^k], [T_{js}^k, T_{if}^k]>\} \quad (3)$$

If $[T^k_{is}, T^k_{if}]$ and $[T^k_{js}, T^k_{jf}]$ do not overlap, then the two robots cannot be in the kth collision zone simultaneously, and therefore no collision will occur in this collision zone.

B. Sufficient Conditions for Collision-Free Scheduling

Figure 2:
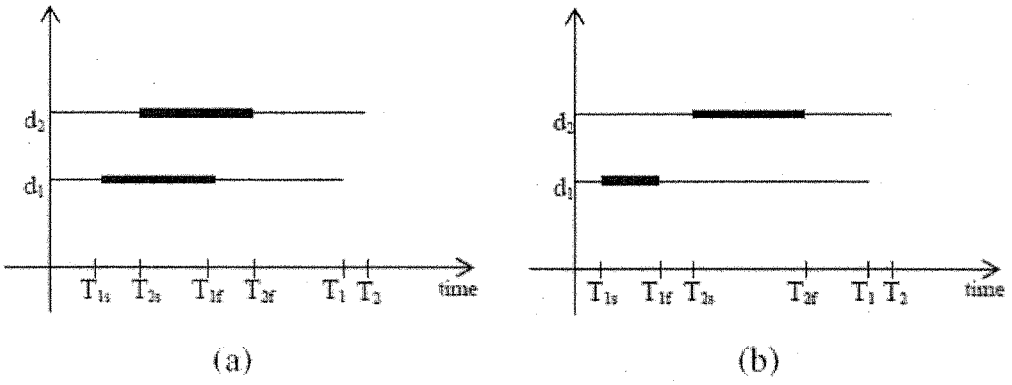
FIG. 2 illustrates timelines for two droplets. The bold lines correspond to the collision-time intervals. (a) Collision can occur. (b) Collision will not occur.

Therefore the sufficient condition for collision avoidance amounts to ensuring that there is no overlap between the two intervals of any collision-time interval pair for the two robots. If $[T^k_{is}+t^{start}_i, T^k_{if}+t^{start}_i] \cap [T^k_{js}+t^{start}_j, T^k_{jf}+t^{start}_j] =$ for every collision-time interval pair, then no collision can occur (FIG. 2). This sufficient condition leads to an optimization problem: Given a set of robots with specified trajectories, find the starting times for the robots such that the completion time for the set of robots is minimized and no two intervals of any collision-time interval pair overlap.

C. Collision-Free Coordination of Multiple Robots

We developed a mixed integer linear programming (MILP) formulation for coordinating the motions of multiple robots with specified trajectories, where only the start times can be modified. Let Ti be the time required for robot Ai to traverse its entire trajectory when starting at time $t^{start}_i=0$. The maximum time for robot $A_t$ to complete its motion, $t^{start}_i+T_i$, is its completion time. The completion time for the set of robots, $t_{complete}$, is the time when the last robot completes its task. Consider coordination of a pair of robots $A_i$ and $A_j$ with specified trajectories. Ensuring the robots are not in their kth collision zone at the same time yields a disjunctive "or" constraint that can be converted to an equivalent pair of constraints using an integer zero-one variable $\delta_{ijk}$ and M, a large positive number [29]. When robot $A_i$ enters the collision zone first, the constraint $t^{start}_i+T^k_{if}<t^{start}_j+T^k_{jf}$ holds and δijk=0, and when robot $A_j$ enters the collision zone first, the constraint $t^{start}_j+T^k_{jf}<t^{start}_i+T^k_{if}$ holds and δijk=1.

Let N be the number of robots. Let Nij denote the number of collision-time interval pairs for robots Ai and Aj, i.e., Nij=|CIij|. We wish to minimize the completion time while ensuring the robots are not in their shared collision zones at the same time. A collision-free solution for this coordination task is given by the MILP formulation:

Minimize $t_{complete}$ subject to $$t_{complete}-t_i^{start}-T_i\geq 0, 1\leq i\leq N$$

$$t_i^{start}+T_{if}^{k}-t_j^{start}-T_{js}^{k}-M\delta_{ijk}\leq 0$$

$$t_j^{start}+T_{jf}^{k}-t_i^{start}-T_{is}^{k}-M(1-\delta_{ijk})\leq 0 \quad (4)$$

for all $<[T_{is}^{k},T_{if}^{k}], [T_{js}^{k},T_{jf}^{k}]>\epsilon CI_{ij}$;
for $1\leq i<j\leq N$ $$t_i^{start}\geq 0, 1\leq i\leq N$$

$$\delta_{ijk}\epsilon\{0,1\}, 1\leq i<j\leq N, 1\leq k\leq N_{ij}.$$

D. Individual Droplet Coordination

Individual droplet coordination to achieve arbitrary layouts is a direct application of the MILP formulation of Equation (4) for the coordination of droplets moving on known paths at constant speeds. We briefly illustrate for the case of matrix layouts. Assume that once a droplet leaves its temporary station, it does not stop until the goal row or column is reached. The droplet going to the (i, j) entry from the left dispense station is defined as $d_{jcir}$, and the droplet going to the same entry from the top dispense station as $d_{irjc}$. The droplet $d_{jcir}$ could collide with $d_{qrpc}$, where q>i and p≤j, so the total number of collision zones $d_{jcir}$ has is j(n−i). Therefore the total number of collision zones (and the number of binary variables) is $$\sum_{i=1}^{m}\sum_{j=1}^{n} j(n-i) = \frac{nm(m-1)(n+1)}{4}$$

We solve the MILP of Equation 4, with a slight modification to ensure successive droplets from a dispenser do not collide.

II. Coordinating Droplets for Matrix Layouts

A. Droplet Matrix Layouts

Figure 3:
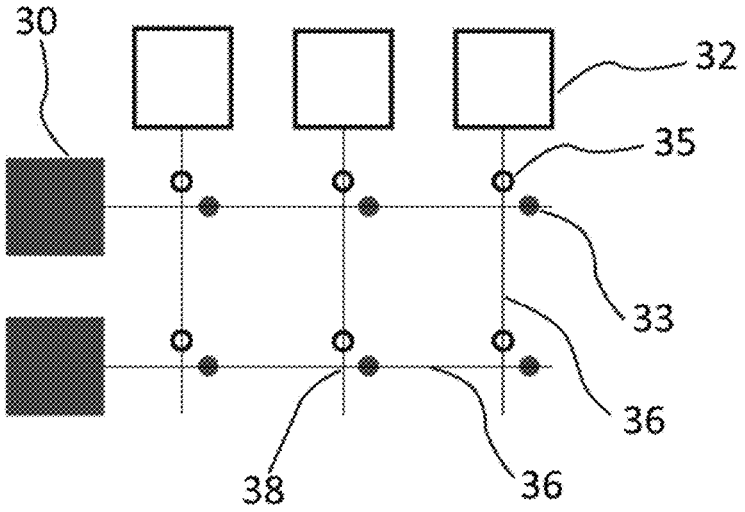
FIG. 3 illustrates an example 2×3 droplet matrix. Hollow and shaded squares are column and row droplet dispense stations respectively, and circles are droplets. Droplet paths are indicated by thin lines. A droplet's appearance indicates its source. Paired droplets at each grid entry will be merged for mixing.

Biochemists often need to perform a large number of tests in parallel (e.g., using microwell plates) so the conditions for each test can be varied. For example, they may want to quantify the effect of differing reagent concentrations on the outcome of a reaction. A grid layout of droplets, also referred to as a matrix layout of droplets, created by mixing droplets obtained from a set of column dispense stations and row dispense stations, each of which contains a particular chemical of a specified concentration, is suitable for such testing (FIG. 3). Such experiments are well suited for execution on optically controlled microfluidic devices.

In FIG. 3, assume there are m row dispense stations 30 on the left and n column dispense stations 32 on the top to create an m×n matrix. Each entry (i, j) in the droplet matrix includes two droplets 33 and 35, each extracted from the left (ith row) and the top (jth column) dispense stations respectively. A sketch of a 2×3 matrix is shown in FIG. 3. The matrix entry locations 38 are implicitly defined by the dispenser locations. We select the paths for the droplets to be the grid lines 36 of the matrix, as in FIG. 3. Each grid line starts from the edge of the corresponding dispense station and extends perpendicular to the dispense station.

There is a region of feasible locations for each entry, which depends on the grid line locations. We select the grid lines to start from the center point of the edges. The subsequent step is to merge and mix the two droplets at each entry. Since a mixing operation can be performed in fixed time, we do not consider it while solving the coordination problem.

We analyze two types of droplet matrices: uniform grid matrices, where the distance intervals between two adjacent entries along any row or column are the same, and nonuniform grid matrices, where the distance between two adjacent rows or columns can be arbitrary. See example uniform and non-uniform grid matrices in FIG. 4 and FIG. 5 respectively.

B. Coordination on Droplet Matrix

The objective is to form the droplet matrix as soon as possible while avoiding collisions. We now analyze the parallel motion of droplets and introduce multiple approaches to achieve this objective. We first state the droplet matrix coordination problem: Given m dispense stations on the left and n dispense stations on the top, create a droplet matrix with m×n entries, and minimize the completion time while avoiding droplet collisions. A matrix entry (i,j) consists of a droplet from the ith row dispense station and a droplet from the jth column dispense station. We assume all droplets move at the same constant velocity. One solution is to coordinate individual droplets using the heretofore described MILP formulation when building the matrix. In addition, we describe two batch coordination strategies. A droplet dispense station is also referred to as a droplet dispenser, and a droplet matrix layout is also referred to as a droplet grid layout.

C. Batch Coordination

In batch coordination, droplets are moved in batches, filling one whole column or one whole row simultaneously. Each batch consists of one row or column of droplets extracted from the dispense stations at the same time. Temporary stations (the dotted circles 44 in FIG. 4) are an extra column or row of stations next to the dispense stations. Each newly extracted batch moves simultaneously to the temporary stations. We assume that once a batch of droplets leaves its temporary station, it will continue moving without stopping until it reaches its destination row or column. A new batch is generated as soon as the current batch leaves the temporary stations. Droplet matrices can be classified into two types, uniform grid and non-uniform grid, based on column and row spacing. We now analyze them separately.

Figure 4:
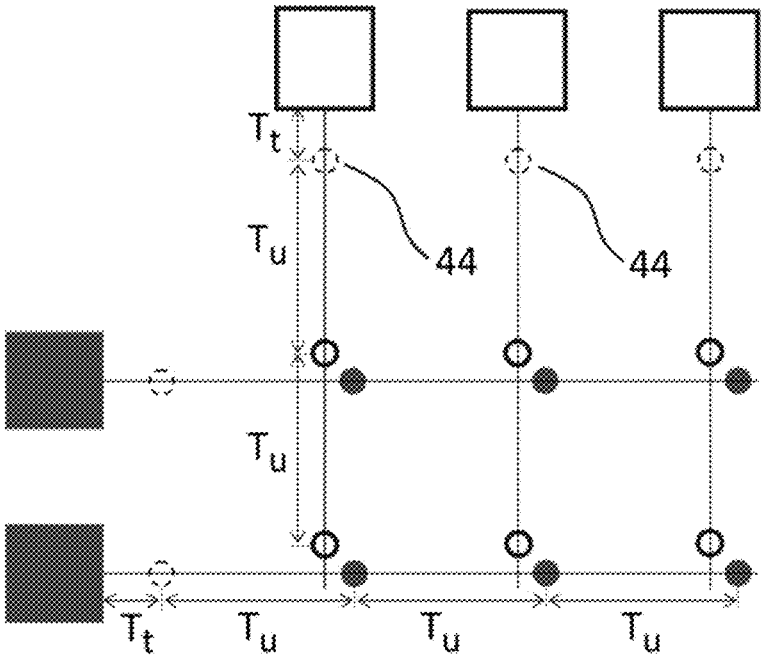
FIG. 4 illustrates an example 2×3 uniform grid droplet matrix. Dotted circles indicate temporary stations.

1) Uniform Grid:

Here the distance intervals between two adjacent entries along any row or column are the same, as in FIG. 4. We assume the speed of all droplets is fixed and equal, and therefore travel time intervals are identical.

The uniform matrix algorithm, also referred to as the uniform grid algorithm, moves batches of droplets to populate the farthest entries first. To avoid collisions, assume it is allowed to have a slight lag time $T_l$ at the temporary stations on the side with more dispense stations, e.g., if m<n, let the lag be on the top, otherwise let the lag be on the left. To be safe, $T_l$ can be defined to equal twice the diameter of the droplet divided by its speed. Each matrix entry contains two stations, one for the droplet from the top and one for the droplet from the left. Select the entry station locations to be vertically and horizontally offset to avoid a droplet at an entry station from blocking the motion of other droplets through the entry. FIG. 4 shows an example with 2×3 dispense stations. A collision will occur at entry (1, 1) if the first batch from the top and first batch from the left start to move at the same time. The lag time mentioned above avoids such collisions. We compute the completion time for the above motion strategy. Let the time taken for extracting one droplet from a dispense station be $T_e$ and the travel time from a dispense station to its corresponding temporary station be $T_t$. Assume the time interval from the temporary station to the first entry is the same as the interval between two adjacent entries $T_u$. Since different batches could move simultaneously and assuming m≤n, the completion time $t_{complete}$ is $$\begin{cases} T_e + T_t + \max\{mT_u + T_l, nT_u\}, \text{ if } T_u > T_e + T_t \\ \max\{m(T_e + T_t) + T_l n(T_e + T_t)\} + T_u, \text{ otherwise.} \end{cases} \quad (5)$$

If Tu>Te+Tt, the droplet batch from the top reservoirs to the farthest rows will take the longest time, mTu+Te+Tt+Tl, among all batches from the top. Similarly, the longest movement time from the left will be nTu+Te+Tt. When Tu≤Te+Tt, a similar analysis applies.

The completion time in Equation 5 can be computed in constant time. This eliminates the need for the MILP formulation for batch coordination on uniform grids.

Figure 5:
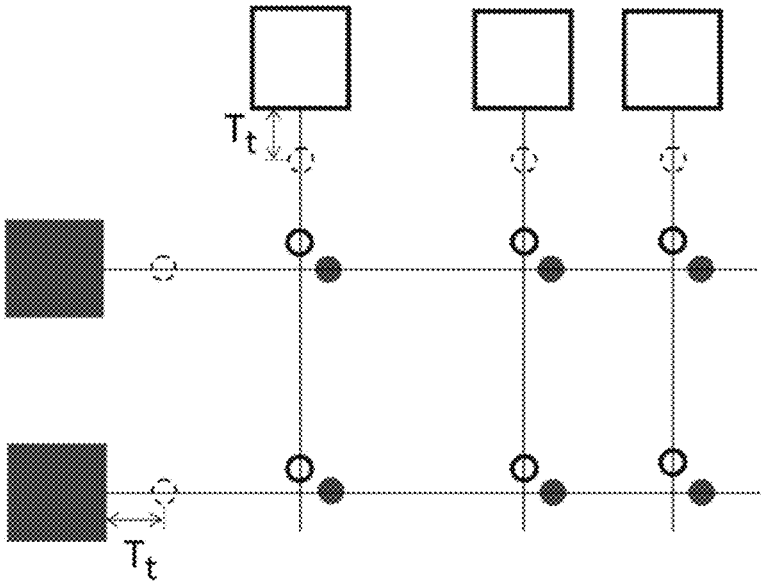
FIG. 5 illustrates an example 2×3 non-uniform grid droplet matrix.

2) Non-Uniform Grid:

Here the distance between two adjacent rows or columns can be arbitrary, as in the example grid of FIG. 5. The batch movement strategy is similar to the uniform case. Start to generate another batch, as soon as one batch leaves the temporary stations. To avoid collisions, a start time delay (computed from the MILP formulation discussed below) is used at temporary stations for corresponding batches.

Let $b_{ir}$ be the droplet batch extracted from the top dispense stations for the ith row and $b_{jc}$ be the droplet batch extracted from the left dispense stations for the jth column. Let $T_{ir}$ be the travel time of $b_{ir}$ from the temporary stations to its goal row. Similarly define $T_{jc}$ for $b_{jc}$. If there is no collision, different batches can move simultaneously and the completion time $t_{complete}$ is $$\max_{i,j}\left\{T_e + T_t + \max\{T_{ir}, T_{jc}\}, \max_{i,j}\{i(T_e + T_t) + T_{ir},\ j(T_e + T_t) + T_{jc}\}\right\}, \quad (6)$$

where $i \in \{1, 2 \ldots, m\}$ and $j \in \{1, 2 \ldots, n\}$.

Equation 6 computes the largest completion time of the droplets from the left and top dispense stations in different situations. More typically, collisions can occur and so we formulate the problem as an MILP coordination problem that minimizes the completion time while ensuring collision-free motion. Since all droplets in a batch move simultaneously, the coordination objects are now the m+n batches (rather than 2mn droplets).

Let $t^{start}_{ir}$ be the start time of batch bar, and similarly, $t^{start}_{jc}$ for $b_{jc}$. Given a pair of batches, the number of collisions k depends on the possible collisions caused by the droplets in each batch. For an m×n matrix, any pair $b_{jc}$ and $b_{ir}$ has j(i−1) potential collision zones ($b_{1r}$ does not cross any other column batches). So the matrix has a total of $$\sum_{i=1}^{m}\sum_{j=1}^{n} j(i-1) = \frac{mn(m-1)(n+1)}{4}$$

potential collision zones. The MILP formulation for batch coordination is:

Minimize $t_{complete}$ subject to $$t_{complete} - T_e - T_t - t_{ir}^{start} - T_{ir} \geq 0, 1 \leq i \leq m$$

$$t_{complete} - T_e - T_t - t_{jc}^{start} - T_{jc} \geq 0, 1 \leq j \leq n$$

$$t_{ir}^{start} - t_{(i+1)r}^{start} \geq T_e + T_t, 1 \leq i \leq m-1$$

$$t_{jc}^{start} - t_{(j+1)c}^{start} \geq T_e + T_t, 1 \leq i \leq n-1$$

$$t_{ir}^{start} - T_{ir}^{kf} - t_{jc}^{start} - T_{jc}^{ks} - M\delta_{irjc}^{k} \leq 0$$

$$t_{jc}^{start} - T_{jc}^{kf} - t_{ir}^{start} - T_{ir}^{ks} - M(1-\delta_{irjc}^{k}) \leq 0 \quad (7)$$

for all $<|[T_{ir}^{ks}, T_{ir}^{kf}], [T_{jc}^{ks}, T_{jc}^{kf}]> \in CI_{irjc}$ for 1≤i≤m and 1≤j≤n $$\delta_{irjc}^{k} \in \{0,1\}, t_{ir}^{start} \geq 0 \text{ and } t_{jc}^{start} \geq 0$$

$$1 \leq i \leq m \text{ and } 1 \leq j \leq n.$$

$\delta_{irjc}^{k}$ is a binary zero-one variable and M is a large positive constant. The third and fourth inequalities represent the filling-farther-entries-first constraint. These two inequalities mean batches going to farther entries are extracted at least Te+Tt prior to batches for their nearer neighbors. In computing the collision interval, define the collision interval as $[t-t_{safety}, t+t_{safety}]$, where $t_{safety}$ is a predefined safety time that ensures that one droplet leaves the collision zone before another one starts to enter.

D. Stepwise Coordination

Since the MILP formulation is NP-hard and has worst-case exponential computational complexity, we have developed a stepwise coordination method with a substantially lower computational complexity. This batch approach is most suitable for non-uniform grids with a large number of rows and/or columns; while it is applicable to uniform grids also, optimal solutions for them can be obtained as heretofore described.

Figure 6:
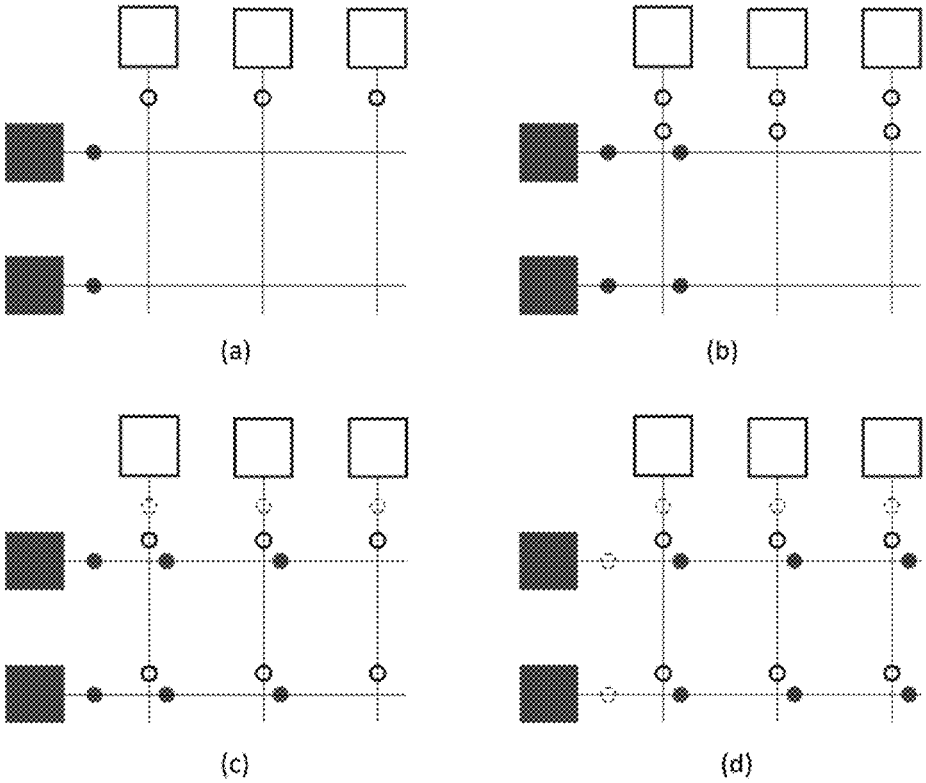
FIG. 6 illustrates stepwise coordination for the 2×3 matrix example. Snapshots (a), (b), (c), and (d) are of the initial state, and after the first, second, and third steps respectively.
Figure 7:
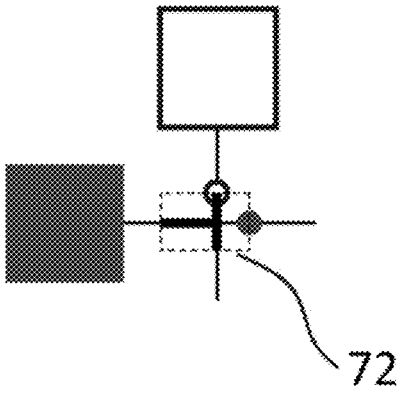
FIG. 7 illustrates a safety zone and entry stations for stepwise coordination.

The move procedure is divided into steps. The number of steps for a general case is max{m, n}. For a 2×3 matrix example, the total number of steps is 3 (FIG. 6). The basic rule is still to fill farthest entries first and move droplets in batches. In each step, each movable batch moves from its current location to its next destination (i.e., the next entry location on its motion path). The following step begins only after all moving batches have reached their next destinations. If some batches arrive at their next destinations earlier than others, they have to wait until all batches complete motion for the current step Stepwise coordination avoids collisions due to the horizontal and vertical location differences of the stations at each entry and the safety zone 72 in FIG. 7 designed to avoid collisions. There is at most one pair of droplets, one from the top and the other from the left, present in the safety zone at the same time. The distance between consecutive entries must be larger than the corresponding width of the safety zone, or the matrix formulation is invalid. FIG. 7 depicts one matrix entry, its safety zone (drawn dotted), and its corresponding dispense stations. When the top and side droplets move to their stations, no collision can occur since their paths do not cross. The vertical dimension of the safety zone is at least 2√2D, where D is the droplet diameter, and is equal to the bold black horizontal segment. Thus when droplets leave the stations, the top unshaded droplet cannot collide with an incoming shaded droplet from the left. If a collision occurred, the incoming shaded droplet must have been in the safety zone before the previous shaded droplet left the safety zone, which violates the one-pair-of-droplets rule.

Figure 8:
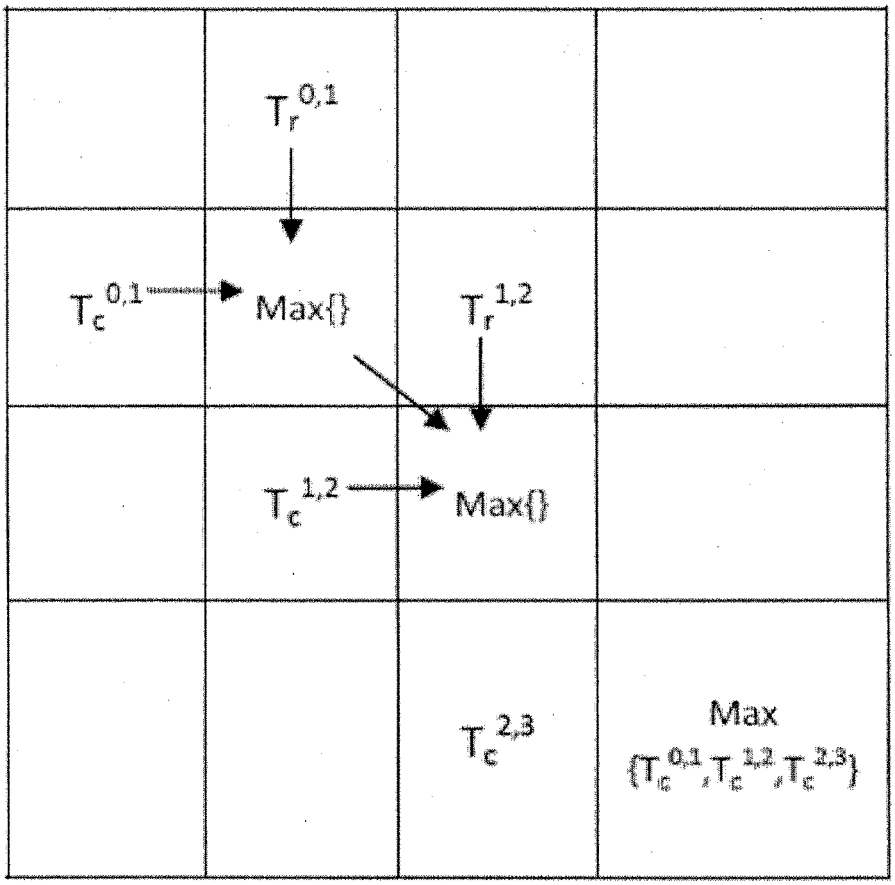
FIG. 8 illustrates a table for computing completion time using stepwise coordination. In the diagonal entries, Max{ } returns the maximum value of input passed from the tails of the arrows.

An analysis of the movement steps and completion time is now described. Let $b_{ir}$ be the batch starting from top temporary stations heading to the ith row entries and bke be the batch from the left temporary stations to the jth column entries. Let $t^{p,q}{}_r$ represent the travel time from row p to row q for $b_{ir}$, and $t^{p,q}{}_c$ be the time for $b_{jc}$ from column p to column q; temporary stations have an index of 0. In FIG. 6(*a*), $b_{2r}$ and $b_{3c}$ are extracted. In the first step, the next destinations of $b_{2r}$ and $b_{3c}$ are row 1 and column 1 respectively. Therefore, the first step takes $\max\{T^{0,1}{}_r, T^{0,1}{}_c\}$ to complete. The second step illustrated in FIG. 6(*b*) is a little more complex. It includes the movement of $b_{1r}$ to row 1, $b_{2r}$ to row 2, $b_{2c}$ to column 1, and $b_{3c}$ to column 2. The travel time is $\max\{T^{1,2}{}_r, T^{1,2}{}_c, \max\{T^{0,1}{}_r, T^{0,1}{}_c\})\}$. In step 3, only batches $b_{1c}$, $b_{2c}$, and $b_{3c}$ from the left move, with a maximum travel time of $\max\{T^{0,1}{}_c, T^{1,2}{}_c, T^{2,3}{}_c\}$. The total completion time is the sum of $T_e$, $T_t$, and the travel times for the three steps. Building a table to record the costs of the steps helps us work out the completion time. FIG. 8 shows the tridiagonal matrix table for the above example. The lower band records $T^{p,q}{}_c$, the travel time between columns; the upper band records the travel time between rows $T^{p,q}{}_r$. The travel time of each step is computed along the diagonal. For an m×n matrix, the computational complexity of filling out the table is O(m+n)+O(max(m, n)), far less than the exponential complexity of MILP coordination. A general formulation to represent the algorithm to calculate the step times is now outlined. For a matrix of dimension m×n, assuming m<n, the sth step time $t_s$ is $$t_s = \begin{cases} \max\{T_r^{0,1}, T_c^{0,1}\} & s = 1, \\ \max\{T_r^{p,q}, T_c^{p,q}, t_{s-1}\} & 2 \le s \le m, \\ \max\{T_c^{0,1}, \ldots, T_c^{s-1,s}\} & m < s < n. \end{cases} \quad (8)$$

Conversely, if m>n, the third equation of Equation 8 becomes $\max\{T^{0,1}{}_r, \ldots, T^{s-1,s}{}_r\}$, n<s<m. The total completion time, therefore, equals $T_e+T_t+\Sigma_{sts}$.

E. Examples

Figure 9:
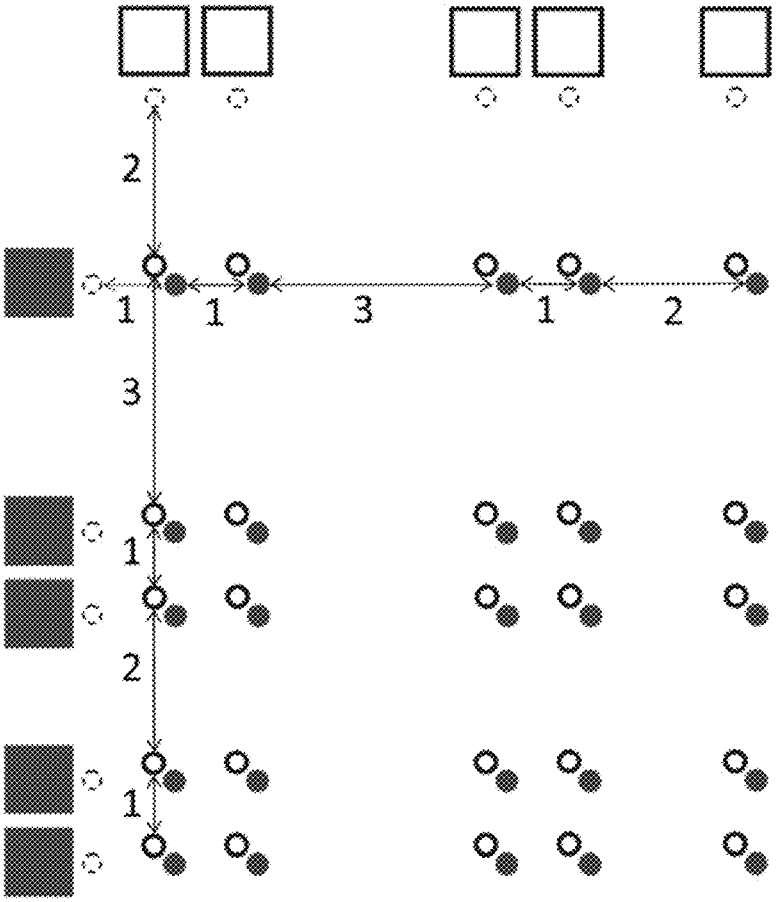
FIG. 9 illustrates a 5×5 droplet matrix layout. Numbers on the first row and column are the time intervals (in seconds) for a speed of 1 cm/s.
Figure 10:
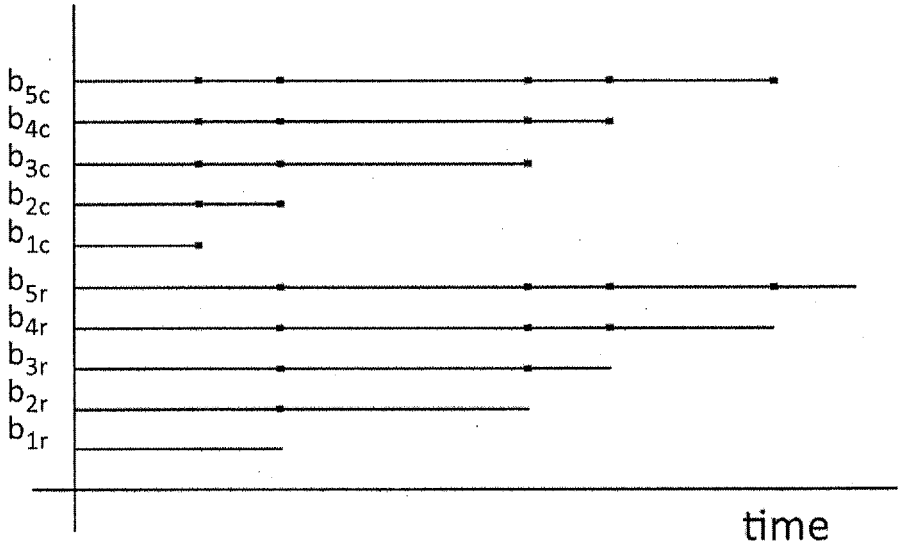
FIG. 10 illustrates timelines for each batch of droplets for the 5×5 example. Bold lines are possible collision time intervals. (a) Timelines before coordination. (b) Timelines after coordination.
Figure 10:
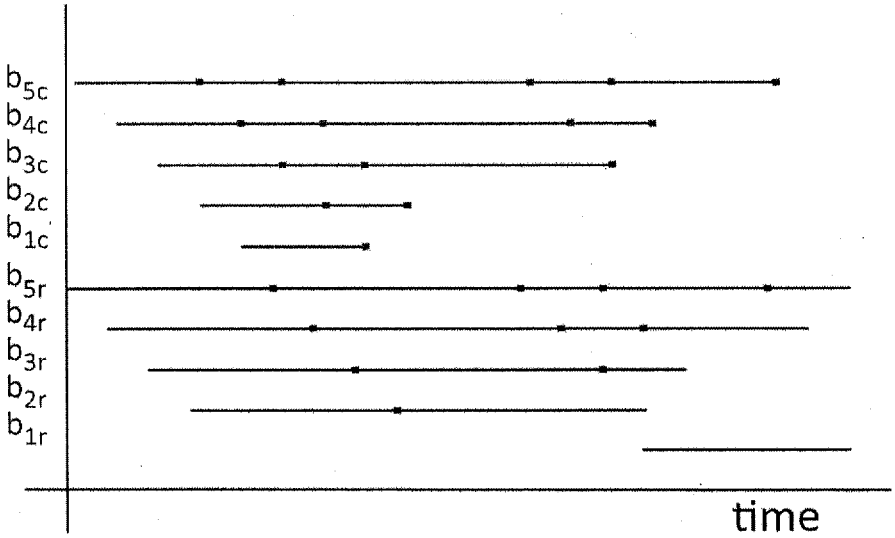

The coordination strategies have been implemented on several examples. IBM ILOG CPLEX Optimizer was used to solve the MILP problems. Consider the 5×5 droplet matrix shown in FIG. 9. Let the diameter of the droplets be 0.5 mm. The maximum speed achieved on an optically controlled microfluidic system is 2 cm/s; the speed of droplets is assumed fixed at 1 cm/s. The intervals between entries are indicated in FIG. 9. The timelines are shown in FIG. 10(*a*). The bold lines are possible collision time intervals ($2t_{safety}$); their length is 0.1 s. The MILP problem for this matrix is formulated based on Equation 7. Let Te+Tt equal 0.5 s. The coordination result is demonstrated in FIG. 10(*b*). CPLEX takes 0.038 s to solve the problem on a 2.53 GHz Intel Xeon E5540 CPU with 12 GB of RAM. The completion time is 9.5 s, which is the lower bound for this specific problem and implies the optimum result was obtained. Coordination results and completion times for individual coordination and batch coordination MILP algorithms, and stepwise coordination algorithm for several non-uniform droplet matrices are shown in Table 1.

TABLE 1

| | Individual | | | Batch | | | Stepwise |
|---|---|---|---|---|---|---|---|
| Matrix size | Completion Time (sec) | Execution Time (sec) | No. of Variables | Completion Time (sec) | Execution Time (sec) | No. at Variables | Completion Time (sec) |
| 2 × 3 | 5.5 | 0.014 | 6 | 5.5 | 0.012 | 6 | 7.5 |
| 4 × 6 | 9.5 | 0.021 | 126 | 9.5 | 0.023 | 126 | 17.5 |
| 8 × 12 | 18.5 | 0.18 | 2184 | 18.5 | 0.20 | 2184 | 35.5 |
| 5 × 5 | 9.5 | 0.03 | 150 | 9.5 | 0.038 | 150 | 14.5 |
| 10 × 10 | 18.5 | 0.37 | 2475 | 18.5 | 0.43 | 2475 | 29.5 |
| 15 × 15 | 29.5 | 14.48 | 11025 | 29.5 | 19.22 | 11025 | 44.5 |

CONCLUSION, RAMIFICATIONS, AND SCOPE

Accordingly, it can be seen that the methods and systems for droplet coordination on optically controlled microfluidic devices of the various embodiments can be used to control and coordinate large numbers of droplets without collisions simultaneously.

In addition to the embodiments described here, the methods and systems described can be applied to a broader set of droplet movement patterns, permitting wait times and varying droplet speeds, and handling cases when the number of dispense stations does not match the number of rows and columns of the droplet matrix. Although droplets are discussed here, the methods and systems described are not limited to droplets and can be applied to beads, particles, cells, and other objects.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention. Thus the scope of the embodiments should be determined by the appended claims and their legal equivalents, rather than by the examples given.

For example, the present invention generally relates to optoelectronic systems for the manipulation of droplets, cells, beads (micro or nano), and molecular matter (e.g., DNA), including optically controlled microfluidic systems, optoelectronic tweezer systems, and optical tweezer systems.

The methods enable the manipulation and coordination of droplets, cells, beads, nanotubes/structures, and molecular matter over a continuous photoconductive surface or in 3D. This can be achieved using one or more of optically controlled microfluidic systems, optoelectronic tweezer systems (including phototransistor-based and photodiode-based optoelectronic tweezer systems), and optical tweezer systems. These could use light sources such as digital projectors, LEDs, LCD screens, or laser beams. These systems may combine one or more mechanisms/phenomena such as optoelectrowetting, dielectrophoresis, and optoelectronic tweezers. They also enable the manipulation and coordination of droplets, cells, beads, nanotubes/structures, and molecular matter in 3D. For example, this can be achieved using holographic optical tweezer systems that use laser beams to create a large number of optical traps to independently manipulate objects.

Advantages:

These methods can be used for multiple applications including cell and particle transport and manipulation, cell sorting, single cell analysis, bead concentration, and bead-based analysis. These can be used in lab-on-chip systems for drug discovery and screening, biological analysis, point-of-care medical diagnostics, and environmental testing.

Applications of the described method and system, in various embodiments, can be advantageously applied to point-of-care testing including clinical diagnostics and newborn screening, to biological research in genomics, proteomics, glycomics, and drug discovery, and to biochemical sensing for pathogen detection, air and water monitoring, and explosives detection.

What is claimed is:

1. A method for controlling and coordinating the movement of one or more droplets, beads, nanostructures, or biological objects, comprising:

using a light source and an optically controlled microfluidic system comprising a continuous photoconductive surface to produce reconfigurable virtual electrodes when light interacts with the continuous photoconductive surface, the reconfigurable virtual electrodes moving the one or more droplets, beads, nanostructures, or biological objects;

using a processor coupled to one or more of the light source and the optically controlled microfluidic system, applying a motion planning algorithm utilizing input regarding one or more of the light source and the optically controlled microfluidic system to control and/or coordinate the movement of the one or more droplets, beads, nanostructures, or biological objects over the continuous photoconductive surface and position the one or more droplets, beads, nanostructures, or biological objects while avoiding undesired collisions by actuating the one or more of the light source and the optically controlled microfluidic system such that the light source interacts with the continuous photoconductive surface as directed by the motion planning algorithm; and using the one or more of the light source and the optically controlled microfluidic system, moving the one or more droplets, beads, nanostructures, or biological objects to a desired position or configuration over the continuous photoconductive surface in accordance with output of the motion planning algorithm;

wherein the one or more droplets, beads, nanostructures, or biological objects are not constrained to movement between physically predefined positions or regions or along physically predefined paths and may move to any desired positions or regions over the continuous photoconductive surface via any desired paths.

2. The method of claim 1, wherein the desired configuration comprises one of a uniform matrix, a non-uniform matrix, and an arbitrary pattern.

3. The method of claim 1, wherein the desired paths comprise one or more of straight-line paths, polygonal paths, and arbitrary paths.

4. A method for controlling and coordinating the movement of one or more droplets, beads, nanostructures, or biological objects, comprising:

using one or more of a light source, an optically controlled microfluidic system, and an optoelectronic tweezer system comprising a continuous photoconductive surface to produce reconfigurable virtual electrodes when light interacts with the continuous photoconductive surface, the reconfigurable virtual electrodes holding the one or more droplets, beads, nanostructures, or biological objects;

using a processor coupled to one or more of the light source, the optically controlled microfluidic system, and the optoelectronic tweezer system, applying a motion planning algorithm utilizing input regarding one or more of the light source, the optically controlled microfluidic system, and the optoelectronic tweezer system to control and/or coordinate the movement of the one or more droplets, beads, nanostructures, or biological objects over the continuous photoconductive surface and position the one or more droplets, beads, nanostructures, or biological objects while avoiding undesired collisions by actuating the one or more of the light source, the optically controlled microfluidic system, and the optoelectronic tweezer system; and using the one or more of the light source, the optically controlled microfluidic system, and the optoelectronic tweezer system, moving the one or more droplets, beads, nanostructures, or biological objects to a desired position or configuration over the continuous photoconductive surface in accordance with output of the motion planning algorithm;

wherein the one or more droplets, beads, nanostructures, or biological objects are not constrained to movement between physically predefined positions or regions or along physically predefined paths and may move to any desired positions or regions over the continuous photoconductive surface via any desired paths.

5. The method of claim 4, wherein the desired configuration comprises one of a uniform matrix, a non-uniform matrix, and an arbitrary pattern.

6. The method of claim 4, wherein the desired paths comprise one or more of straight-line paths, polygonal paths, and arbitrary paths.

7. A system for controlling and coordinating the movement of one or more droplets, beads, nanostructures, or biological objects, comprising:

a light source and an optically controlled microfluidic system comprising a continuous photoconductive surface producing reconfigurable virtual electrodes when light interacts with the continuous photoconductive surface, the reconfigurable virtual electrodes moving the one or more droplets, beads, nanostructures, or biological objects; and a processor coupled to one or more of the light source and the optically controlled microfluidic system applying a motion planning algorithm utilizing input regarding one or more of the light source and the optically controlled microfluidic system to control and/or coordinate the movement of the one or more droplets, beads, nanostructures, or biological objects over the continuous photoconductive surface and position the one or more droplets, beads, nanostructures, or biological objects while avoiding undesired collisions by actuating the one or more of the light source and the optically controlled microfluidic system such that the light source interacts with the continuous photoconductive surface as directed by the motion planning algorithm;

the one or more of the light source and the optically controlled microfluidic system moving the one or more droplets, beads, nanostructures, or biological objects to a desired position or configuration over the continuous photoconductive surface in accordance with output of the motion planning algorithm;

wherein the one or more droplets, beads, nanostructures, or biological objects are not constrained to movement between physically predefined positions or regions or along physically predefined paths and may move to any desired positions or regions over the continuous photoconductive surface via any desired paths.

8. The system of claim 7, wherein the desired configuration comprises one of a uniform matrix, a non-uniform matrix, and an arbitrary pattern.

9. The system of claim 7, wherein the desired paths comprise one or more of straight-line paths, polygonal paths, and arbitrary paths.

10. A system for controlling and coordinating the movement of one or more droplets, beads, nanostructures, or biological objects, comprising:

one or more of a light source, an optically controlled microfluidic system, and an optoelectronic tweezer system comprising a continuous photoconductive surface producing reconfigurable virtual electrodes when light interacts with the continuous photoconductive surface, the reconfigurable virtual electrodes holding the one or more droplets, beads, nanostructures, or biological objects; and a processor coupled to one or more of the light source, the optically controlled microfluidic system, and the optoelectronic tweezer system applying a motion planning algorithm utilizing input regarding one or more of the light source, the optically controlled microfluidic system, and the optoelectronic tweezer system to control and/or coordinate the movement of the one or more droplets, beads, nanostructures, or biological objects over the continuous photoconductive surface and position the one or more droplets, beads, nanostructures, or biological objects while avoiding undesired collisions by actuating the one or more of the light source, the optically controlled microfluidic system, and the optoelectronic tweezer system;

the one or more of the light source, the optically controlled microfluidic system, and the optoelectronic tweezer system moving the one or more droplets, beads, nanostructures, or biological objects to a desired position or configuration over the continuous photoconductive surface in accordance with output of the motion planning algorithm;

wherein the one or more droplets, beads, nanostructures, or biological objects are not constrained to movement between physically predefined positions or regions or along physically predefined paths and may move to any desired positions or regions over the continuous photoconductive surface via any desired paths.

11. The system of claim 10, wherein the desired configuration comprises one of a uniform matrix, a non-uniform matrix, and an arbitrary pattern.

12. The system of claim 10, wherein the desired paths comprise one or more of straight-line paths, polygonal paths, and arbitrary paths.

* * * * *